United States Patent [19]

Hara et al.

[11] Patent Number: 4,724,784

[45] Date of Patent: Feb. 16, 1988

[54] DEVICE FOR CHANGING A LOWER THREAD RUNNING PATH FOR A ZIGZAG SEWING MACHINE

[75] Inventors: Kazumasa Hara; Mikio Koike, both of Tokyo; Mituru Nishijima, Tachikawa, all of Japan

[73] Assignee: Janome Sewing Machine Co., Ltd., Tokyo, Japan

[21] Appl. No.: 913,551

[22] Filed: Sep. 26, 1986

[30] Foreign Application Priority Data

Sep. 27, 1985 [JP] Japan ..... 60-212696

[51] Int. Cl.[4] ..... D05B 57/08

[52] U.S. Cl. ..... 112/467; 112/302

[58] Field of Search ..... 112/182, 184, 302, 467

[56] References Cited

U.S. PATENT DOCUMENTS

| | | | |
|---|---|---|---|
| 2,327,817 | 8/1943 | Parry | 112/467 X |
| 3,894,499 | 7/1975 | Hamlett | 112/467 X |
| 4,250,824 | 2/1981 | Meier et al. | 112/467 X |
| 4,340,003 | 7/1982 | Hanyu et al. | 112/467 X |

*Primary Examiner*—Andrew M. Falik

*Attorney, Agent, or Firm*—Michael J. Striker

[57] ABSTRACT

A device for changing a lower thread running path in a zigzag sewing machine includes a guiding member positioned between a lower thread holder and a needle plate and having an obliquely positioned guiding face the obliquity of which to the direction of the needle amplitude is controlled to selectively produce straight stitches or zigzag stitches.

4 Claims, 13 Drawing Figures

FIG_1
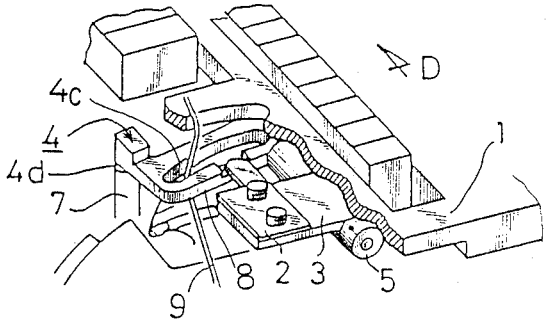
FIG_2
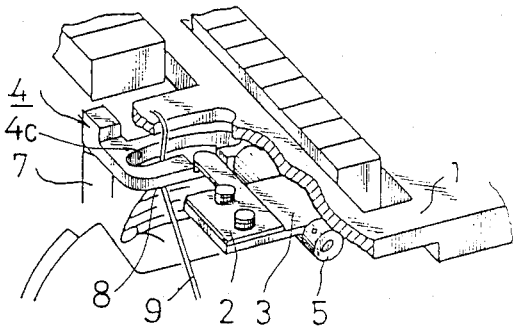
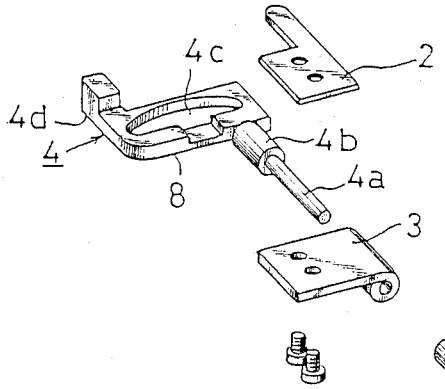
FIG_3

FIG_7
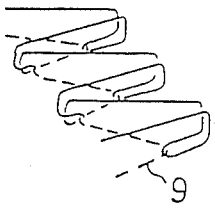
FIG_9
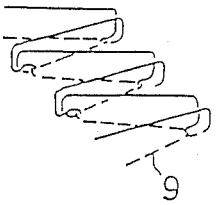
FIG_6
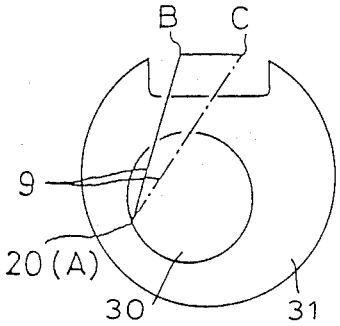
FIG_8
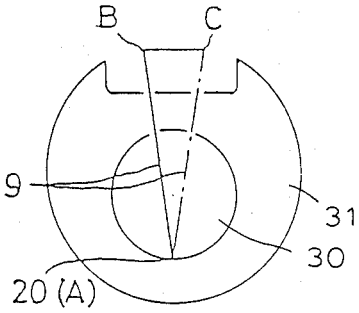
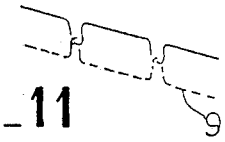
FIG_11
FIG_10
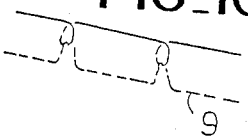
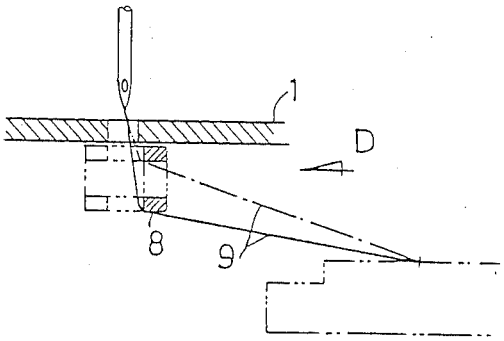
FIG_12(a)
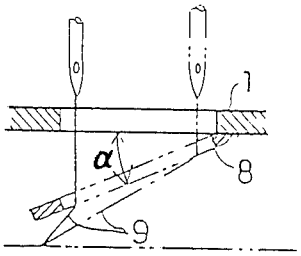
FIG_12(b)

DEVICE FOR CHANGING A LOWER THREAD RUNNING PATH FOR A ZIGZAG SEWING MACHINE

BACKGROUND OF THE INVENTION

The present invention relates to a device of changing a running path of a lower thread for desired zigzag stitches.

In zigzag stitchings of the prior art, a positional relation between stitching and a thread catching device is as shown in FIG. 6, as seen from a top of a stitching bed, and a lower thread exit 20 is offset to the left side with respect to a needle amplitude (B–C).

Therefore, consumption amounts of required lower threads in zigzag stitching are different in the needle lateral amplitudes from B to C and from C to B. Assuming that the lower thread exit 20 is A and a feed amount is 0, the former consumption amount is BC+AC−BA, while the latter consumption amount is BC+BA−AC, and since the consumption amount by the former is larger, the stitches are formed as shown in FIG. 7 in that the lower thread is biased to the left side.

To avoid biasing of the lower thread, if the lower thread exit 20 is provided at the center as shown in FIG. 8, the consumption amount of the lower thread is made equal in the both needle amplitudes, that is the needle is moved from B to C and from C to B, and stitches as shown in FIG. 9 may be formed.

However, sometimes when a straight stitching is carried out, abnormal stitches can be formed as shown in FIG. 10.

Such abnormal stitches can be avoided by providing the lower thread exit hole 20 which is offset from the center as shown in FIG. 6 (see FIG. 11).

Thus, different exits for passing the lower thread are required to be suited to the zigzag stitching and also the straight stitching.

SUMMARY OF THE INVENTION

It is an object of this invention to avoid abnormal stitches during the stright stitching in a zigzag machine by positioning the lower thread exit hole offset to the left side with respect to the needle amplitude as shown in FIG. 6, providing a member for guiding the lower thread between a lower thread holder and a needle plate in order to compensate for a difference in the lower thread consumption amount due to said positioning of the lower thread exit hole, and controlling an obliquity of a lower thread guiding face of said guide member.

If the lower thread guide face is tilted, the thread guiding position is varied in height with respect to the amplitude of the lower thread, whereby the above mentioned difference between A–B and A–C is changed by difference in heights, caused by positioning of said guide member.

BRIEF DESCRIPTION OF THE DRAWINGS

FIG. 1 is a schematic perspective view of a control part of the sewing machine for zigzag stitching according to a first embodiment;

FIG. 2 is a schematic perspective view of the of the control part of FIG. 1 but for straight stitching;

FIG. 3 is an exploded perspective view of the control part;

FIG. 6 is a schematic view showing the needle drop point and the consumption amount of the lower thread with an offset thread exit;

FIG. 7 is a view of biased zigzag stitches of the lower thread;

FIG. 8 is a schematic view of the needle drop point consumption amount of the lower thread with a centrally positioned thread exit.

FIG. 9 is a schematic view showing non-baised stitches;

FIG. 10 is view of abnormal straight stitches;

FIG. 11 is a view of normal straight stitches; and

FIGS. 12(*a*) and 12(*b*) illustrate the relationship between the obliquity of the lower thread guiding face and the lower thread consumption amount.

DETAILED DESCRIPTION OF PREFERRED EMBODIMENTS OF THE INVENTION

Figure 4:
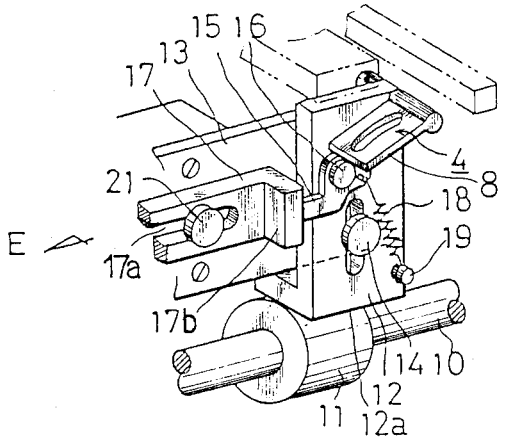
FIG. 4 is a perspective view view of a control part of the sewing machine for zigzag stitching according to a second embodiment.

The first embodiment of the invention is shown in FIGS. 1 to 3.

A control part of the sewing machine includes an attaching plate 3 secured via a plate spring 2 to the lower surface of a needle plate 1 held to a machine bed.

The attaching plate 3 has an internal recess which is fitted with a shaft 4*a* of a lever 4 as seen in FIG. 3 and is held between a boss 4*b* of shaft 4*a* and a collar 5 which is fixed to the shaft 4*a* by a pin 6 so that the lever 4 is made rotatable.

The lever 4 is formed with a groove 4*c* for guiding a lower thread 9, and is in contact with a push-up member 7 at its end part 4*d* against the pressure of the plate spring 2, which push-up member is in contact with an actuator (not shown).

FIG. 1 shows the control part for performing the zigzag stitching, where the push-up member 7 is moved down by the actuator and the lever 4 is accordingly tilted at the left side of the needle with respect to a fabric feed direction, shown by arrow D, by the plate spring 2, and a lower thread guiding face 8 formed at the lower part of the groove 4*c* is made oblique from the right side of the left side. The difference in the consumption amounts of the lower thread due to the needle position is amended by the difference in height by the lower thread guiding face 8 (see FIG. 12). FIG. 12(*a*) is a partial sectional view of the attaching plate 1 with the part of the lever with the guiding face 8. In FIG. 12(*a*), the lower thread bobbin is illustrated by the phantom lines. Angle $\alpha$ in FIG. 12(*b*) is the angle of the inclination of the guiding face 8 for guiding the lower thread.

FIG. 2 shows the control part for performing the straight stitching, where the push-up member 7 is moved up by the actuator, and the lever 4 is flush with the surface of the needle plate 1 so that no influences on the stitching process is given by the guide face 8 said needle plate for the zig-zag embodiment predetermines the maximum lateral swing of the needle.

The second embodiment will be explained with reference to FIGS. 4 and 5. The control part of the second embodiment also draws out the lower thread to the lower thread guiding face 8 for stitching.

A reference numeral 10 designates a cam shaft which is rotatably supported to the machine frame and is rotated in synchronism with a vertical movement of the needle (not shown). A cam 11 is mounted on the outer circumference of the shaft 10. Numeral 12 is a lower thread drawing-out bed, and its bottom side 12*a* is in contact with the cam 11 by a spring means (not shown). A stationary plate 13 is fixed by a pin 14 passing through an oblong hole formed in the bed 12 for effecting the vertical movement thereof. Collar 5, pin 6 and axial shaft 4*a*, are in this embodiment the same as in the first embodiment.

A numeral 15 designates a cam plate which is rotatably pivoted to the thread drawing-out bed 12 at a pin 16 and is at its cam face in contact, under pressure, with the lower face of the lever 4 by means of a spring (not shown).

A numeral 17 shows an actuating plate which is, at its one end, secured to the actuator, and is formed with a groove 17*a* into which a pin 21 fixed to the stationary plate 13 is inserted so as to guide the actuating plate 17 laterally. The cam plate 15 is at its end in contact with an end point 17*b* of the actuating plate 17, and holds one end of a spring 18. The other end of the spring 18 is held by a spring pin 19 supported on the lower thread drawing-out bed 12, so that the cam plate 15 is pressed to the actuating plate 17.

FIG. 4 shows the embodiment for the zigzag stitching, where the actuating plate 17 is retreated in the direction of arrow E, and the cam plate 15 is rotated clockwise and is at its small diameter portion in contact with the lower face of the lever 4 so as to tilt the lever 4, and thereby to amend the difference in the amount of lower thread consumption, which has been made by the needle drop point position when the lower thread exit hole is provided at the left side with respect to the needle amplitude, and the lower thread bed 12 is moved vertically by the rotation of the cam 11 to draw out the lower thread from the lower face 8 of the lever 4.

Figure 5:
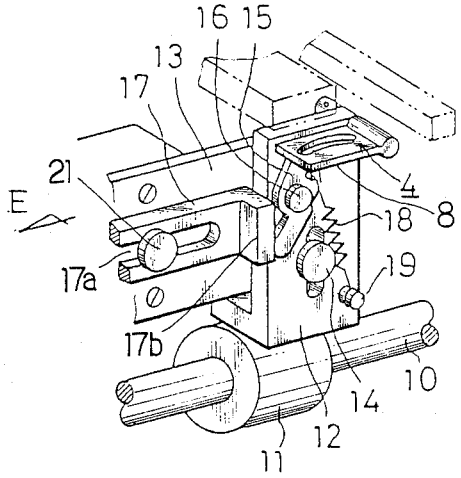
FIG. 5 is a perspective view of the control part of FIG. 4 but for straight stitching.

FIG. 5 shows the embodiment for the straight stitching, where the actuating plate 17 is moved reversely to the direction of the above mentioned arrow E, and the cam plate 15 is rotated counterclockwise and is at its large diameter portion in contact with the lower face of the lever 4 so as to make the lever 4 parallel with the needle plate 1. The bed 12 is moved vertically by the rotation of the cam 11 so as to draw out the lower thread on the lower face of the lever 4.

In the first and second embodiments, the lever 4 is tilted by the actuator, but it may depend on a mechanical means connected to a stitch selection device.

To emphasize what has already been stated in the Background the zigzag sewing machine generally has a loop taken or needle thread catching mechanism (not shown) rotated in a horizontal plane. The lower thread 9, which is wound around a bobbin 30 (FIG. 6) carried by a bobbin carrier 31 or a lower thread holder received in the loop taker, is extended to a needle position B from a point 20 located leftward of the left end needle position B within the maximum needle lateral swinging range B–C as viewed from an operator as shown in FIG. 6.

In this case, the straight stitches, which are generally formed at the needle position B, are normally formed as shown in FIG. 11 in which the upper and lower threads are correctly interconnected.

However, in the case of the zigzag stitching, a greater amount of the lower thread 9 is required at the needle position C than the amount required at the needle position B as shown in FIG. 6.

Therefore the zigzag stitches could be deformed as shown in FIG. 7 in which the upper thread is drawn out too much at the needle position C due to the tension of the lower thread 9.

It may be reasonable that the desired zigzag stitches be formed as shown in FIG. 9 if the lower thread 9 is extended from the point 20(A) in FIG. 8 which is located at the apex A of the equilateral triangle A, B, C. However in this case, the straight stitches, which may be formed at either of the needle positions B or C, are deformed as shown in FIG. 10 in which the upper and lower threads are abnormally interconnected.

It is therefore desirable that the straight stitches be formed in the relative condition of FIG. 6 and the zigzag stitches be formed in the relative condition of FIG. 8. It is therefore an object of this invention to selectively provide two relative conditions depending upon the types of stitches to be produced such as the straight stitches and zigzag stitches.

According to the invention, it is actually possible to provide substantially the same condition as that of FIG. 8 by providing the lever 4 having the thread guide face 4*c* formed thereon.

According to the present invention, in the conventional type having the lower thread exit hole for preventing the occurence of abnormal stitches in the straight stitching, it is possible to prevent the lower thread from biasing of stitches due to the difference in the consuming amounts of the lower thread caused by the difference in the needle dropping positions.

We claim:

1. A device for changing a lower thread running path for a zig-zag sewing machine when straight stitches are being made thereon, said machine being provided with a needle which vertically reciprocates and laterally swings, and a needle thread catching mechanism for producing zig-zag stitches in association with said needle and including a lower thread holder and a needle plate, said changing device comprising a guiding member positioned between said holder and said needle plate and provided with an lower thread guiding face for guiding the lower thread in a running path between said lower thread holder and said lower thread guiding face of said guiding member; and means for controlling an obliquity of said guiding face relative to an upper surface of said needle plate, whereby the production of abnormally biased straight stitches is prevented in the sewing machine by changing the direction of said lower thread running path.

2. A device for changing a lower thread running path for a zigzag sewing machine having a needle carrying an upper thread and vertically reciprocated and swingable laterally in respect to a fabric feeding direction within a predetermined maximum needle lateral swinging range provided in a needle plate, a bobbin carrying a lower thread and supported by a bobbin carrier received in a loop taker rotated to catch the upper thread to interlock the upper thread with the lower thread to form a stitch, a exit hole (20A) provided on the bobbin carrier for guiding the lower thread away from the bobbin to a fabric to be sewn, said exit hole (20A) being positioned leftwardly of a left end needle position of the maximum needle lateral swinging range as viewed by the operator, said changing device comprising a lever (4) having one end turnably mounted between said needle plate and said bobbin, said lever extending transversely across the running path of the lower thread extended between said exit hole (20A) and said left end needle position and having a lower thread guide face; and means for changing an angle of said lever vertically between an upper inoperative position and a lower operative position with respect to said lower thread, so as to change an obliquity of said lower thread guide face so that in said lower operative position of said lever said lower thread guide face will change the lower thread running path with respect to said left end needle position and a right end needle positon, which defines an opposite end of said maximum needle lateral swinging range.

3. The device as defined in claim 2, wherein said angle changing means comprises a spring biasing said lever in a downward direction and a member movable in a first direction to move said lever in one direction against the action of said spring, and said member movable in an opposite second direction to allow said spring to move said lever in the direction opposite to said one direction.

4. The device as defined in claim 2, further comprising a bed (12) supporting said lever (4) between said needle plate and said bobbin, said bed being vertically movable; a rotational shaft (10); and a cam (11) secured to said rotational shaft for rotation therewith, said cam being in engagement with said bed to vertically move said bed, to thereby vertically move said lever with respect to the lower thread for drawing out the lower thread.

* * * * *